US006467763B1

(12) United States Patent
Depoi et al.

(10) Patent No.: US 6,467,763 B1
(45) Date of Patent: Oct. 22, 2002

(54) SYSTEM FOR ASSEMBLING COLLATION SETS FROM A SPLIT WEB

(75) Inventors: Arthur H. Depoi, Brookfield, CT (US); Richard Rochford, East Brunswick, NJ (US); Stanley Rydzak, Brookfield; Richard F Stengl, Wolcott, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/553,567

(22) Filed: Apr. 20, 2000

(51) Int. Cl.[7] ..... B65H 39/00

(52) U.S. Cl. ..... 270/52.09; 270/52.07; 225/99; 225/106; 271/9.1; 271/9.12

(58) Field of Search ..... 270/52.07, 52.09; 225/93, 98, 99, 106; 271/9.1, 9.12

(56) References Cited

U.S. PATENT DOCUMENTS 4,456,127 A * 6/1984 Hams ..... 270/52.09
4,502,676 A * 3/1985 Stocker ..... 270/52.09
4,717,127 A 1/1988 Kish et al. ..... 270/58
5,025,609 A * 6/1991 Moser et al. ..... 225/101
5,104,104 A 4/1992 Mol ..... 270/18
5,540,370 A * 7/1996 Ring ..... 225/100
5,704,604 A * 1/1998 Koelle et al. ..... 270/52.09
5,768,959 A 6/1998 Lorenzo ..... 83/74
6,109,603 A * 8/2000 Stevens et al. ..... 270/52.07
6,244,584 B1 * 6/2001 Holbrook et al. .... 270/52.09 X

* cited by examiner

*Primary Examiner*—Christopher P. Ellis
*Assistant Examiner*—Patrick Mackey
(74) *Attorney, Agent, or Firm*—Angelo Chaclas; Christopher J. Capell; George M. Macdonald

(57) ABSTRACT

A method and corresponding system for assembling collation sets from a split web consisting of two webstreams, each providing a series of collations of connected sheets. The method includes the steps of: alternately selecting the two webstreams and from the selected webstream drawing a sheet to a cutting or bursting station; cutting or bursting the sheet to separate it from the webstream; conveying the sheet to an accumulating station where sheets are accumulated; monitoring the sheet for determining whether the sheet is a beginning or an end of a collation; and ejecting the sheets accumulated from the selected webstream based on the determining of whether the sheet is the beginning or the end of a collation. In some applications, the step of determining whether the sheet is the beginning or the end of a collation is performed based on a barcode on the sheet indicating that the sheet is the last sheet in a collation, and in some other applications based on a barcode on the sheet indicating that the sheet is the first sheet in a next collation.

9 Claims, 4 Drawing Sheets

SYSTEM FOR ASSEMBLING COLLATION SETS FROM A SPLIT WEB

TECHNICAL FIELD

The present invention pertains to feeding a web of collations as part of the processing of a mailing system, and more particularly to feeding a web from a first module that center-slits the web into side-by-side portions, to later modules of the mailing system where the sheets of the two webstreams are accumulated.

BACKGROUND OF THE INVENTION

A web is a continuous stream of forms separated by transverse lines of weakening called perforations. Generally, having documents in web form versus individual separate documents increases throughput in various types of document handling systems. Thus, many different types of document handling systems, such as printers and inserter systems, have been adapted to accommodate webs.

A web is often processed by an inserter system. Inserter systems are well known in the art and are generally used by organizations to facilitate producing a large volume of mailings. Often, the input to an inserter system is a web of computer-generated and printed documents where each document contains information intended for a particular addressee.

It is the function of the inserter system to accept the web and to produce individual mailings that correspond to each document. To accomplish this, a typical inserter includes a variety of modules, each for performing a different task. There are often various web handling modules (slitters, cutters and bursters) for separating the continuous streams of forms into singular or discrete documents, an accumulator module for assembling discrete documents into a collation, a folder module for folding the collation into a desired configuration (such as a Z-fold, C-fold or half-fold), feeder modules for adding sheets to the collation, and an inserter station module for inserting the collation into an envelope.

Although such prior art systems as described above generally perform well, problems exist when handling certain types of webs in some applications. Some webs are comprised of forms that are approximately 11 by 18 inches in dimension and are joined along their major length to form the web of continuous forms. Thus, the major length of the forms is transverse to the longitudinal dimension of the web. Accordingly, this allows a computer printer to create two 8.5 by 11 inch printouts or documents side-by-side on each web form. Inserter systems incorporate an upstream web slitter module to cut the web along its longitudinal center line so as to create two side-by-side web portions. In this instance, each side-by-side web portion contains 8.5 by 11 inch forms that are joined along their minor length. Once the web has been slit along its center line, the next downstream operation is typically to separate the now smaller web forms into discrete documents. To achieve this, either a burster module or a cutter module is used. The burster module separates the forms by tearing them off from one another along the perforations. Thus, the perforations assist the bursting operation. In contrast, the cutter module separates the forms from one another by cutting along or near the perforations without assistance from the perforations. Although slitting the web to create side-by-side web portions is relatively easy, interfacing the two web portions with the adjacent downstream module of the inserter, whether it is a burster module or a cutter module, presents difficulties.

Most burster modules and cutter modules accept two web portions in what is commonly referred to as "2-up" orientation. In this arrangement, two web streams are fed into the burster or cutter module in upper-lower relationship, i.e. one web portion over the other web portion. This is in direct contrast to the side-by-side relationship of the two web portions as they exit the slitter module. Thus, operational difficulties are created when interfacing the slitter module to an adjacent downstream burster or cutter module. As the two web portions emerge from the slitter module, the two portions are first separated and then directed so as to bring one portion over the other.

The "2-up" burster and cutter modules typically feed each of the two web portions in alternating-collation fashion, feeding all of a collation on one side, and then all of another collation on the other side, and so on. When the two streams of web first reach the burster or cutter module, it selects one or the other side to process. While it is processing the side first selected, the forms conveyor continues to feed both sides. Thus, the other side of the web builds up in front of the burster or cutter, while the first side is being processed. Depending on the length of the collations being processed, the result is that sometimes the buildup is excessive and causes paper handling problems, some problems being caused because the takeup by the burster or cutter imparts a jerky motion to the web, disordering the buildup.

What is needed is a system for feeding a 2-up, north-south formatted web to a cutter or burster in a way that avoids having an excessive length of one side of the web from accumulating in an uncontrolled way while the other side is processed by the cutter or burster.

SUMMARY OF THE INVENTION

Accordingly, the present invention provides a system and corresponding method for assembling collation sets from a split web consisting of two webstreams, each providing a series of collations of connected sheets, the method including the steps of: alternately selecting the two webstreams and from the selected webstream drawing a sheet to a cutting or bursting station; cutting or bursting the sheet to separate it from the webstream; conveying the sheet to an accumulating station where sheets are accumulated; monitoring the sheet for determining whether the sheet is a beginning or an end of a collation; and ejecting the sheets accumulated from the selected webstream based on the determining of whether the sheet is the beginning or the end of a collation.

In a further aspect of the method, the step of determining whether the sheet is the beginning or the end of a collation is performed based on a barcode on the sheet indicating, in one embodiment, that the sheet is the last sheet in a collation, and in another embodiment, that the sheet is the first sheet in a next collation.

The system corresponding to the method of the present invention, again for assembling collation sets from a split web, the split web consisting of two webstreams each providing a series of collations of connected sheets, includes: a cutter or burster, responsive to the two webstreams, for drawing a sheet alternately from each webstream to a respective port, for providing a cut or burst sheet; a conveyor, responsive to the cut or burst sheet, for conveying the cut or burst sheet to an accumulating station; a dual accumulator, responsive to the cut or burst sheet at the accumulating station, for accumulating the sheet in an accumulating area; means for monitoring the sheet for determining whether the sheet is a beginning or an end of a collation; and means for ejecting a collation in an accumulating area based upon the determining of whether the sheet is the beginning or the end of a collation.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION

Figure 1:
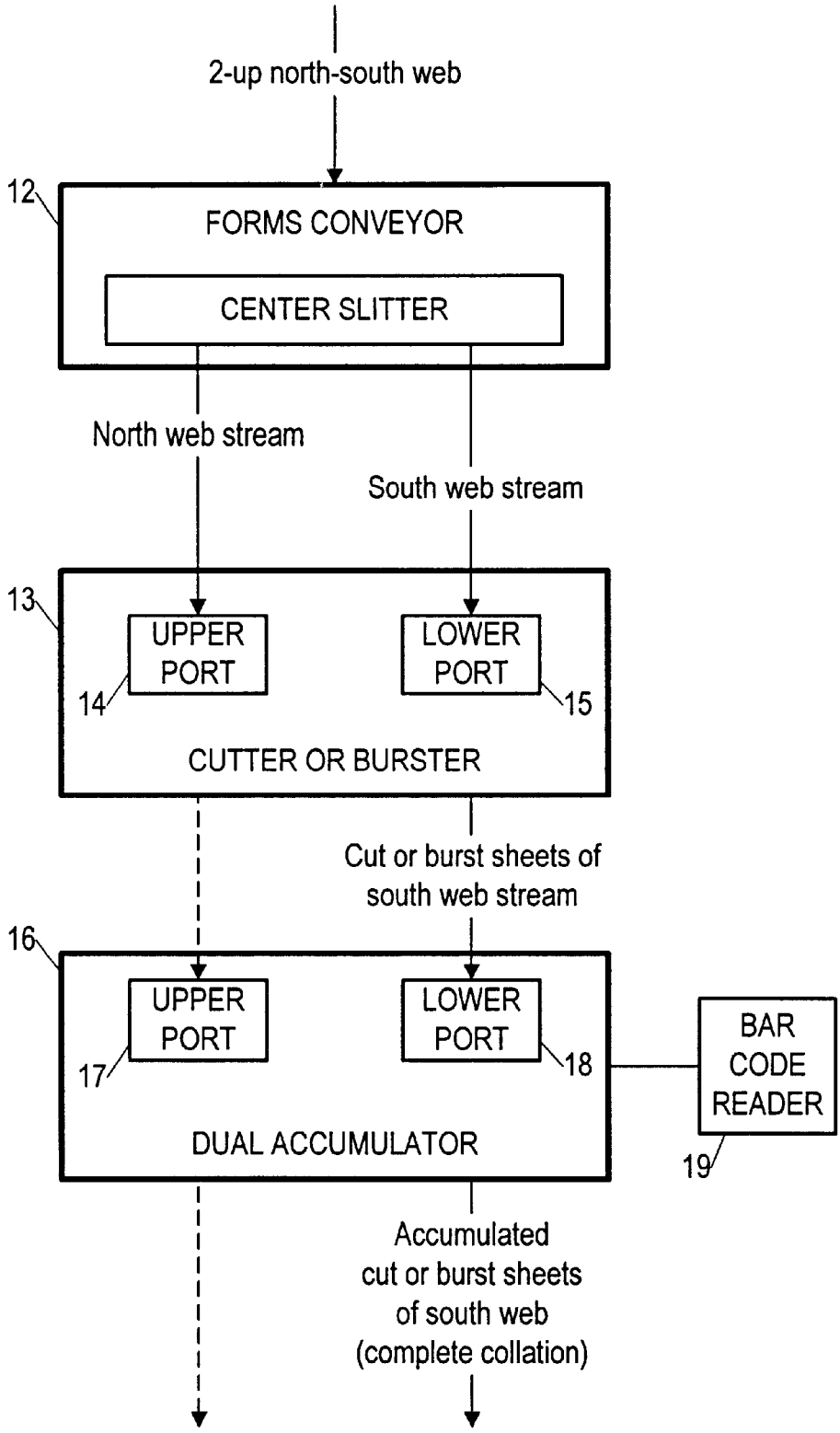
FIG. 1 is a block diagram of a system for which the method of the present invention is intended.
Figure 3:
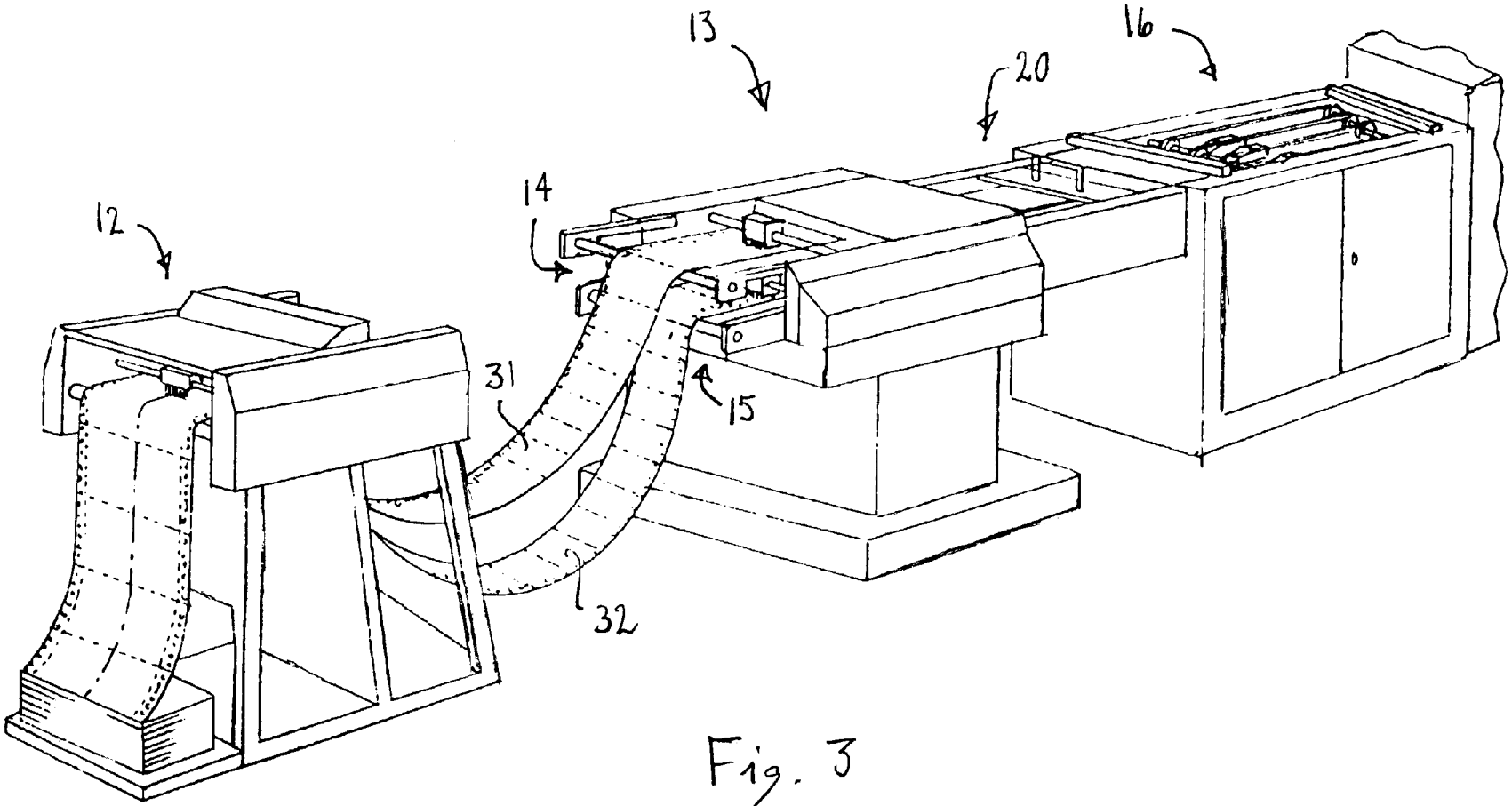
FIG. 3 is a perspective drawing of equipment used to practice of the present invention.
Figure 4:
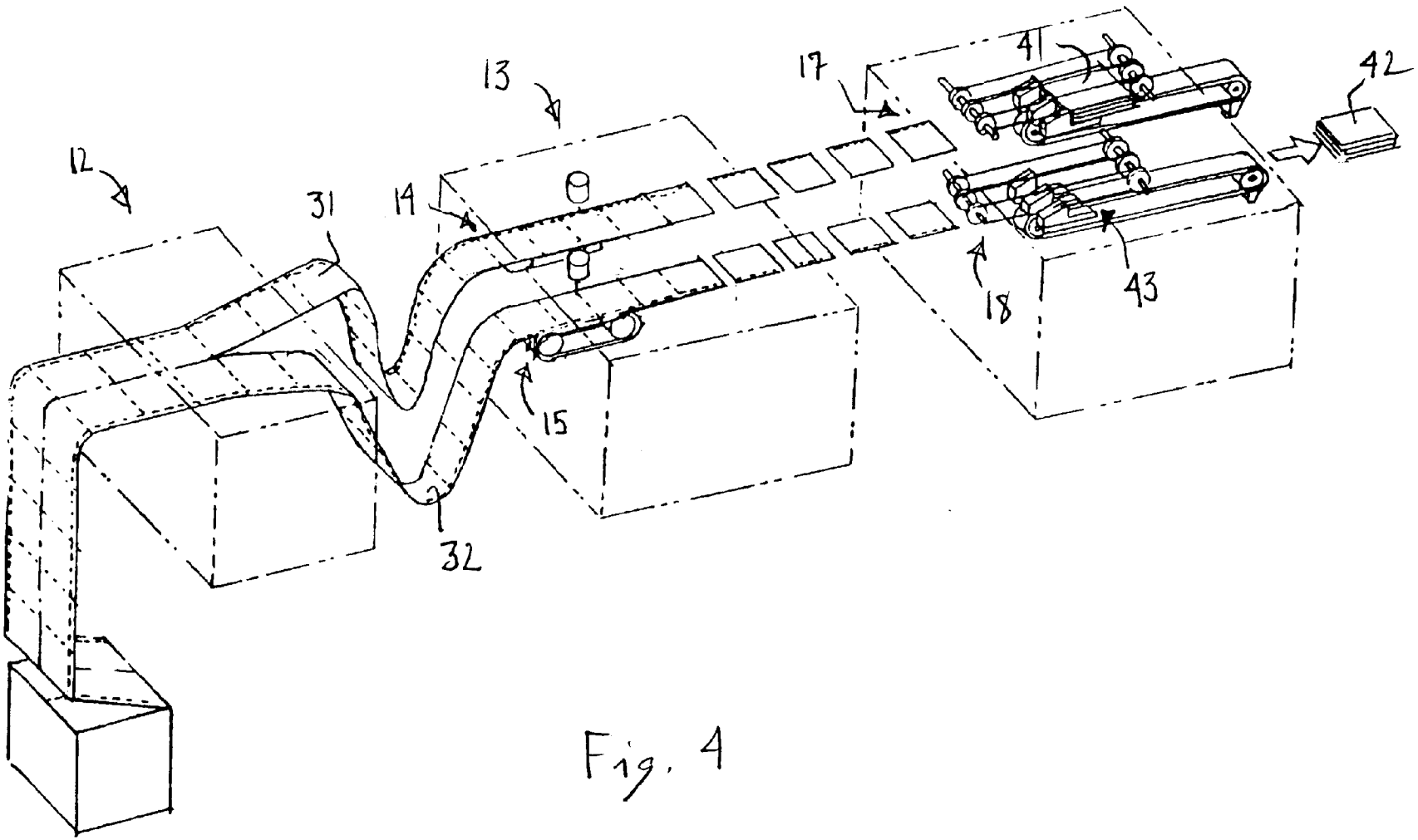
FIG. 4 is a perspective drawing showing the internal arrangement of equipment used to practice the present invention.

Referring now to FIGS. 1, 3 and 4, a system for assembling collation sets from a slit web provided by a forms conveyor 12 is shown as including a cutter 13 and a dual accumulator 16. The system is part of a larger mailing system. The forms conveyor 12 includes a center-slitter (FIG. 1) that takes a two-up north-south web (webstream) and provides a north webstream 31 and separate south webstream 32. The cutter or burster 13 includes an upper port 14 and lower port 15 for feeding into the cutter or burster 13 the north webstream 31 and south webstream 32. The cutter or burster 13 is used, according to the present invention, to cut or burst alternately a sheet from the north webstream and a sheet from the south webstream, providing the cut or burst sheets to the upper port 17 and lower port 18, respectively, of the dual accumulator 16. The cut or burst sheets are conveyed from the cutter or burster 13 to the upper port 17 and lower port 18 respectively of the dual accumulator 16 by a conveyor 20 (FIG. 3).

Still referring to FIGS. 1, 3 and 4, a bar code reader 19 (FIG. 1) monitors the cut or burst sheets of each webstream to determine when a collation begins or ends. (All of a collation is provided by a single webstream.) When the bar code reader 19 indicates that a collation 42 (FIG. 4) has been fully accumulated by the accumulator 16, the accumulator ejects the collation 42 so that it can be further processed by other equipment in the mailing system. It is critical to the present invention that the cutter or burster 13 cut or burst a sheet from the north webstream 31 and a sheet from the south webstream 32 alternately. A port of the cutter or burster 13 feeds first one sheet still connected to its webstream and cut or burst that sheet from the webstream and provides it to the accumulator 16, and then performs the same cutting or bursting of a sheet from the other webstream, and so on. Thus, there is never any appreciable accumulation of webstream between the forms conveyor 12 and the cutter or burster 13.

Figure 2:
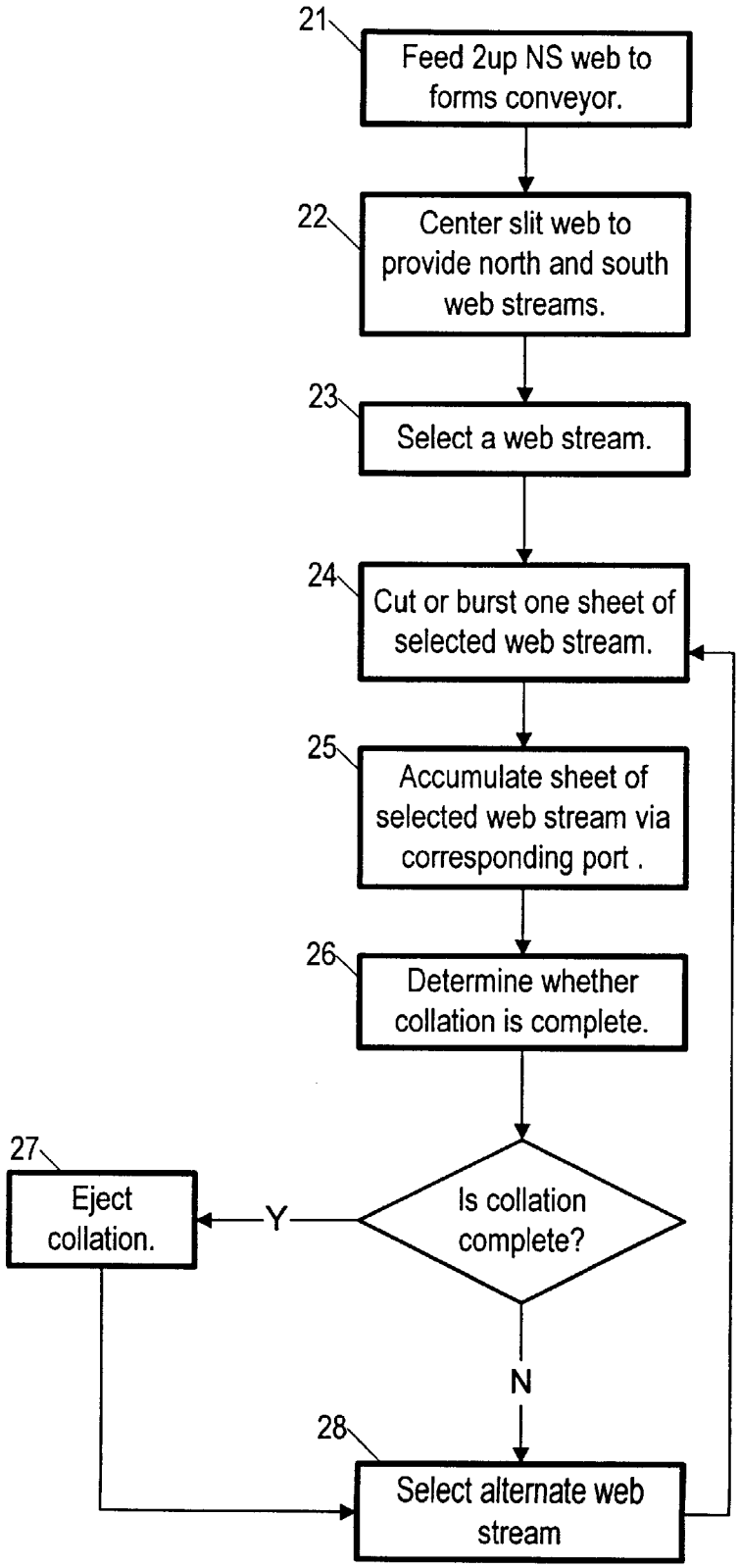
FIG. 2 is a flowchart showing a method according to the present invention.

Referring now to FIG. 2, a method for assembling collation sheets from a split web, using equipment such as in FIG. 1, is shown as beginning with a step 21 in which a two-up north south web is fed to a forms conveyor. Next, in a step 22, the two-up north south web is center-slit to provide north and south webstreams directed to upper and lower ports respectively of a cutter or burster. In a next step 23, the cutter or burster selects one or the other of the two webstreams, and in a step 24 cuts or bursts one sheet of the selected webstream. In a step 25, the cut or burst sheet is accumulated in a collation staging area 43 (FIG. 4) of a dual accumulator. In a next step 26, based for example on a bar code provided on at least some of the sheets being accumulated, it is determined whether the collation is complete. If the collation is complete, then in a step 27, the collation is ejected from the accumulator. Regardless of whether a collation is complete, the accumulator next selects an alternate webstream and repeats the steps beginning with a step 24 of cutting or bursting a sheet of the selected webstream.

Referring now in particular to FIG. 4, the sheets are accumulated in the dual accumulator 16 in one or the other of two accumulation areas, such as the south accumulator area 43. In the preferred embodiment, the sheets in the accumulator area are ejected when the bar code reader 19 (FIG. 1) senses that a sheet being accumulated is the last sheet in a collation. In another embodiment, a collation in a webstream is ejected when a barcode on a sheet in the webstream indicates it is the first sheet in a new collation.

It is to be understood that the above-described arrangements are only illustrative of the application of the principles of the present invention. Numerous modifications and alternative arrangements may be devised by those skilled in the art without departing from the spirit and scope of the present invention, and the appended claims are intended to cover such modifications and arrangements.

What is claimed is:

1. A method for assembling collation sets from a split web, the split web consisting of two webstreams each providing a series of collations of connected sheets, the method comprising the steps of:

alternately selecting the two webstreams and from the selected webstream drawing a sheet to a cutting or bursting station;

cutting or bursting the sheet to separate it from the webstream;

conveying the sheet to an accumulating station for the selected webstream where sheets are accumulated, the accumulating station having a first accumulator for accumulating the separated sheets from the first webstream into collations and a second accumulator for accumulating the separated sheets from the second webstream into collations;

monitoring the sheet for determining whether the sheet is a beginning or an end of a collation; and ejecting the sheets accumulated from the selected webstream based on the determining of whether the sheet is the beginning or the end of a collation.

2. A method as in claim 1, wherein the determining of whether the sheet is the beginning or the end of a collation is performed based on a barcode on the sheet indicating that the sheet is the last sheet in a collation.

3. A method as in claim 1, wherein the determining of whether the sheet is the beginning or the end of a collation is performed based on a barcode on the sheet indicating that the sheet is the first sheet in a next collation.

4. A system for assembling collation sets from a split web, the split web consisting of two webstreams each providing a series of collations of connected sheets, the system comprising:

a cutter or burster, responsive to the two webstreams, for drawing a sheet alternatively from each webstream to a respective port, for providing a cut or burst sheet;

a conveyor, responsive to the cut or burst sheet, for conveying the cut or bust sheet to an accumulating station;

a dual accumulator, responsive to the cut or burst sheet at the accumulating station, for accumulating the sheet in an accumulating area, the accumulating station having a first accumulator for accumulating the separated sheets from the first webstream into collations and a second accumulator for accumulating the separated sheets from the second webstream into collations;

means for monitoring the sheet for determining whether the sheet is a beginning or an end of a collation; and means for ejecting a collation in an accumulating area based upon the determining of whether the sheet is the beginning or the end of a collation.

5. A system as in claim 4, wherein the means for ejecting a collation in an accumulating area is responsive to a bar code on the sheet indicating that the sheet is the first sheet in a new collation.

6. A system as in claim 4, wherein the means for ejecting a collation in an accumulating area is responsive to a bar code on the sheet indicating that the sheet is the last sheet in a collation.

7. An apparatus for assembling collation sets from a split web, the split web consisting of two webstreams each providing a series of collations of connected sheets comprising:

a sheet separator for receiving the two webstreams and for alternatively separating a sheet from each webstream and conveying the separated sheets to a conveyor;

the conveyor arranged for receiving the separated sheets from the sheet separator;

a dual accumulator arranged for receiving the separated sheets from the conveyor having a first accumulator for accumulating the separated sheets from the first webstream into collations and a second accumulator for accumulating the separated sheets from the second webstream into collations;

at least one monitor for determining collation breaks in each of the webstreams; and at least one ejector responsive to the at least one monitor for ejecting the collations from the dual accumulator.

8. An apparatus according to claim 7, wherein the sheet separator is a burster.

9. An apparatus according to claim 7, wherein the sheet separator is a cutter.

* * * * *